United States Patent [19]

Milo

[11] Patent Number: 4,667,544

[45] Date of Patent: May 26, 1987

[54] CONTAINER OPENING AID

[76] Inventor: Michael E. Milo, 5770 Evansville Rt., Box 31, Evansville, Wyo. 82636

[21] Appl. No.: 771,414

[22] Filed: Aug. 30, 1985

[51] Int. Cl.[4] ..... B67B 7/44

[52] U.S. Cl. ..... 81/3.09; 81/3.55; 7/151

[58] Field of Search ..... 81/3.09, 3.4, 3.55; 7/151

[56] References Cited

U.S. PATENT DOCUMENTS 3,495,284 2/1970 Weingardt ..... 81/3.55 X 4,455,894 6/1984 Roberts ..... 81/3.55 X 4,466,313 8/1984 Gardner ..... 81/3.55

4,474,087 10/1984 Widman ..... 81/3.4 X

*Primary Examiner*—Roscoe V. Parker

[57] ABSTRACT

An opener aid for pop-top containers and twist-off bottle caps is worn as a ring on the second joint of either right or left index finger and has a wedge-shaped spur or lug for insertion under the lifter or a pop-top can. The outside surface forms an engagement surface which may be knurled or corrugated to engage the adjoining corrugations of a twist-off bottle cap while applying torque thereto.

8 Claims, 9 Drawing Figures

FIG. 1
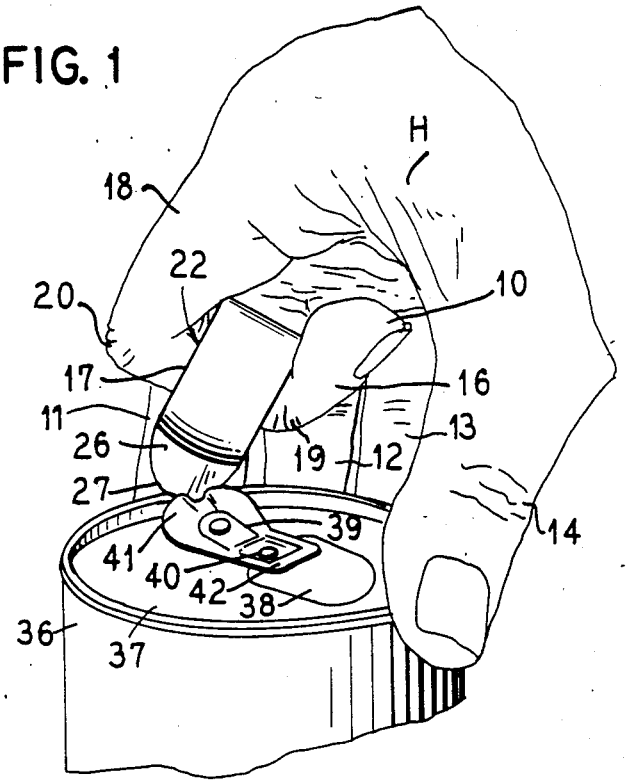
FIG. 2
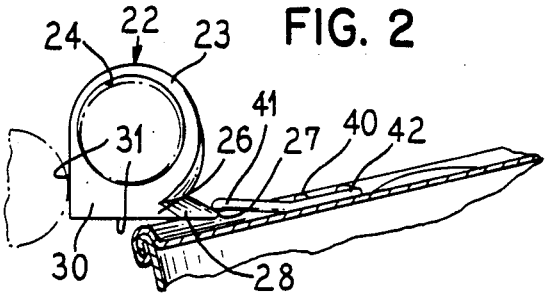
FIG. 3
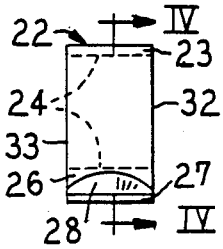
FIG. 4
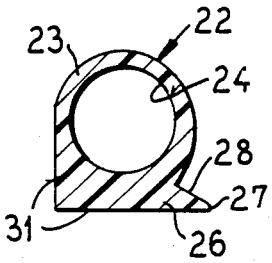
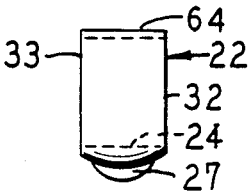
FIG. 5
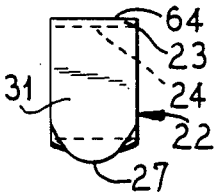
FIG. 6
FIG. 7
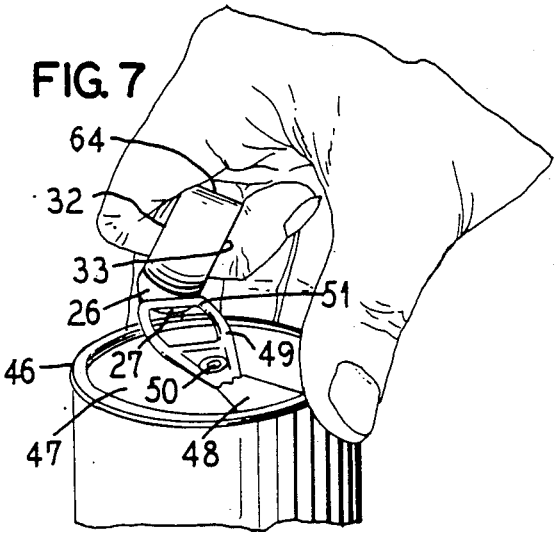
FIG. 8
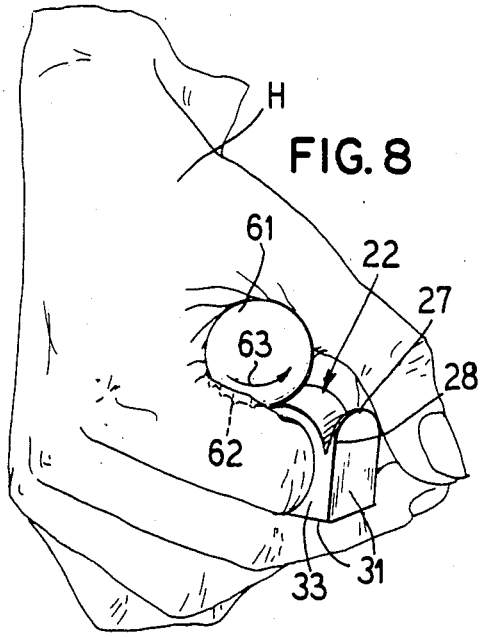
FIG. 9
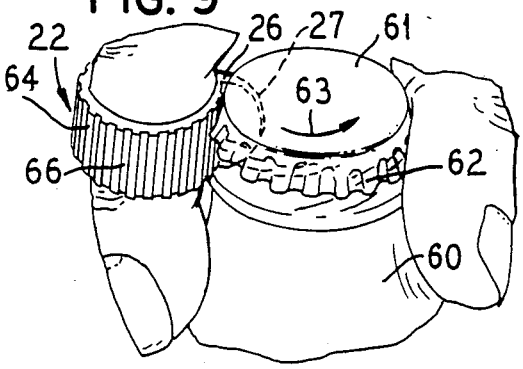

CONTAINER OPENING AID

BACKGROUND OF THE INVENTION

1. Field of the Invention

This invention relates generally to container openers and more particularly to an opening aid for pop-top cans and twist-off bottle caps.

2. Description of the Prior Art

Can openers and bottle openers of the prior art generally provide some form of a lever, either with a sharpened offset apical end for cutting openings into a can by prying on the edge of the can, or by providing a lifting lug for lifting a cap off of a bottle.

However, in recent years, beverage cans are commonly provided with so-called pop-top closures. In one form of closure, a lifter ring is pivotally connected to a prescored closure which is integral with the top of the can. Upon manipulation of the lifter ring, the closure is disconnected from the can top to afford access to the contents of the can.

In another form of closure, the lifter is hingedly connected to the can top and upon manipulation, levers a prescored closure downwardly to afford access to the contents of the can.

In both forms, the lifter element is initially disposed in flat adjacency to the can top. In order to manipulate the lifter, it is necessary to pry the lifter upwardly, an operation which is often times accompanied by frustration, broken fingernails, injured fingertips and lacerated hands.

Bottled products such as beverages are also provided with press-on caps capable of being lifted off with a conventional bottle opener. However, such caps are frequently provided with a twist-off capability so that the bottle can be opened without a bottle opener tool. However, if the corrugations of the twist-off cap are grasped firmly enough to apply twisting torque, the user is apt to suffer, cuts, lacerations or bruises.

SUMMARY OF THE INVENTION

In accordance with the principles of the present invention, an opener aid is provided which comprises a ring shaped member sized to be received on the index finger of a user, either left hand or right hand, and a lifting lug projecting out of the circular loop of the ring is provided to engage the lifter of a pop-top can. The ring shape member also has a circumferentially extending external surface formed to provide an engagement surface for engagingly abutting the corrugations of a twist-off container cap whereby twisting torque is readily applied, which engagement surface itself may be optionally corrugated. By making the ring out of a suitable plastic material, sufficient resilience is provided to afford a firm purchase on an adjoining container top. The ring is an inexpensive item which is provided with one or more flat faces forming an indicia-bearing surface for reception of an advertising logo or the like.

BRIEF DESCRIPTION OF THE DRAWINGS

FIG. 1 is a perspective fragmentary view showing the opener aid of the present invention in place on the index finger of a user and positioned for operation relative to one form of a pop-top can;

FIG. 2 is a somewhat sectional view illustrating additional details of the invention as shown in FIG. 1.;

FIG. 3 is an elevational view showing the container opening aid of the present invention;

FIG. 4 is a cross-sectional view taken on line IV—IV of FIG. 3;

FIG. 5 is a plan view of one side of the opener aid of FIGS. 3 and 4;

FIG. 6 is an opposite plan view of the opposite side of the opener aid of FIGS. 3, 4 and 5;

FIG. 7 is a view somewhat similar to FIG. 1 but showing the opener aid of the present invention in connection with another form of pop-top can;

FIG. 8 is a fragmentary view showing an opener aid in accordance with the present invention as applied to a twist-off bottle cap; and FIG. 9 is a fragmentary view showing optionally provided engagement corrugations for enhancing the twist-off capabilities of the opener aid.

DESCRIPTION OF THE PREFERRED EMBODIMENTS

Referring to FIG. 1, the hand of a user is shown at H. In this illustrative embodiment, a right hand is shown having an index finger 10, a middle finger 11, and so-called ring finger 12 and a little finger 13. The thumb of the hand H is shown at 14.

According to conventional information on the construction of the human hand, the average human finger is approximately 4½ inches in length. Further, the index finger of the average user has three principal joints, namely, a first joint 16, a second joint 17 and a third joint 18. The joints 16 and 17 are connected by a knuckle 19 and the joints 17 and 18 are separated by a knuckle 20.

The container opener aid of the present invention is completely versatile since it can be used with equal effectiveness by both a right handed user or a left handed user. It has been determined that the opener aid of the present invention is favorably sized when it is worn on the second joint 17 of either a left index finger or a right index finger. Accordingly, the opener aid of the present invention is shown generally at 22 and comprises a ring-shaped member or circumferentially extending ring 23 which prescribes a through opening 24 sized to fit over the second joint of the average finger.

In accordance with the principles of the present invention, the ring-shaped body or ring 23 is particularly characterized by a circumferentially extending spur or lug 26. The lug 26 may be formed as an integral part of the body 23 and has a wedge-shaped configuration so that it converges generally outwardly to a thin edge 27, thereby forming a chisel point 28 which is particularly adapted for insertion under the lifter element of a pop-type can.

In the form of the invention shown in FIGS. 2–6, the lug 26 is formed integrally on the ring body and projects circumferentially out of the loop of the ring, the lug 26 being an enlargement on one or both sides of the ring-shaped body.

If desired, the lug 26 may be formed as a projection from an enlarged portion 30 which extends across the width of the opener aid 22 thereby to provide a pair of flat surfaces 31,31.

The opener aid 22 also has spaced apart flat radial walls 32 and 33. Thus, the flat portions 31, 32 and 33 form indicia-bearing surfaces on which may be printed appropriate advertising messages or advertising logos since the opener aid is an economical element which can be conveniently manufactured and distributed as a promotional item. As positioned in FIG. 1, the flat surface 31 faces upwardly, thereby prominently displaying any ad logo thereon.

In FIG. 1, a well-known form of pop-top can is shown generally at 36 and has an integral top 37 on which is formed a prescored closure 38 connected to a lifter 39. The lifter has a hinged connection to the top 37 as at 40 and has an entrant edge 41 adapted to be lifted by a user. Thus, a lever end 42 pries and engages the closure 38 downwardly when the lifter 39 is raised upwardly and affords access to the contents of the can 36.

In the form of can shown in FIG. 7, the can is shown at 46 and at a top 47. Again, a closure 48 is formed as prescored element in the top 47. A lifter ring 49 is pivotally connected as at 50 to the closure 48 and a ring loop is shown at 51 which is manipulated by the user so that upon raising the lifter 49, the closure 48 is physically removed from the top of the can 47.

In both instances, the lifter 39 or the lifter 49 is closely spaced adjacent to the top of the cans 37 and 47 respectively. In order to raise the lifters, the operation is frequently accompanied by frustration, broken fingernails, injured fingertips and lacerated hands.

In accordance with the principles of the present invention, the leading edge 27 of the lug 26 is quickly and conveniently inserted under the entrant edge of the lifter 39 as shown at 41 or under the ringer loop 51 of the lifter 49. Such insertion is depicted in FIG. 2 as well as in FIGS. 1 and 7 and shows the leading edge wedging the lifter upwardly on the wedge shaped lug 28.

The opener 8 of the present invention also has special utility in connection with removing twist-off caps from bottle-type containers. Thus, in FIG. 8 there is shown a bottle 60 having a press on-type bottle cap 61 which is characterized by the usual corrugations 62. In normal circumstances, a bottle opener tool can be used to engage the corrugations 62 and snap the cap 61 off of the top of the bottle in order to afford access to the contents of the bottle 60. However, such caps 61 are frequently provided with a twist-off capability so that if the cap is subjected to a torque applied in the direction of the arrow 63, the cap may be readily removed from the top of the bottle.

It is contemplated in accordance with the principles of the present invention that the opener aid 22 be made of a plastic material. Thus, the material may be selected to be a plastic of sufficient resilience so that a good purchase bite will be obtained between the opener aid 22 and the corrugations 62 of the bottle cap, thereby facilitating the application of a twisting torque. Moreover, the external peripheral surface of the opener aid 22 between the walls 23 and 33 is shown at 64, thereby to form a circumferentially extending engagement surface on the outer periphery of the ring. If desired, the ring-shaped member 22 may be provided knurling or with corrugations 66 as shown on FIG. 9, thereby to enhance the gripping characteristics of the engagement surface 64.

Although various modifications might be suggested by those skilled in the art, it should be understood that I wish to embody within the scope of the patent warranted hereon all such modifications as reasonably and properly come within the scope of my contribution to the art.

I claim:

1. An opener aid comprising:

a ring, and a lug on said ring shaped to provide a wedge-shaped projection for insertion under the lifter of a pop-top container, whereby the user may conveniently actuate the lifter in response to an upwardly directed force applied by the user, and a circumferentially extending engagement surface on the outer periphery of said ring made of a material sufficiently resilient to obtain a firm purchase with the adjoining corrugations of a twist top removable in response to the application of torque.

2. An opener aid as defined in claim 1 and knurling corrugations on said circumferentially extending engagement surface to facilitate engagement with the adjoining corrugations of a twist top.

3. An opener aid as defined in claim 1 and flat transverse faces forming indica-bearing surfaces to receive appropriate indicia thereon.

4. An opener aid comprising:

a ring-shaped member sized to be received on the index finger of a user, and a lifting lug on said ring projecting out of the circle loop of the ring to engage the lifter of a pop-top can, said lifting lug comprising a wedge-shaped element converging to a sharp edge to facilitate insertion of the edge under the lifter of a pop-top can, said ring-shaped member having a circumferentially extending external surface formed with knurling to provide an knurled engagement surface for engagingly abutting the corrugations of the twist-off container cap.

5. An opener aid comprising:

a ring-shaped member sized to be received on the index finger of a user, and a lifting lug on said ring projecting out of the circle loop of the ring to engage the lifter of a pop-top can, said lifting lug comprising a wedge-shaped element converging to a sharp edge to facilitate insertion of the edge under the lifter of a pop-top can, said ring shaped member having a circumferentially extending external surface formed to provide an engagement surface for engagingly abutting the corrugations of the twist-off container cap, and said aid is made of a plastic material sufficiently resilient to afford a firm purchase with an adjoining container cap.

6. A container opener aid assisting a user to open containers comprising:

a body member having a generally circular through opening sized to receive a selected digit of a user's hand, and a circumferentially extending surface on said body spaced radially outwardly of said through opening and forming a cap engaging surface, said cap engaging surface being formed of a material sufficiently resilient and elastic to facilitate a firm purchase with the adjoining knurled or corrugated surface of a twist-off container cap removable in response to the application of torque, and a lug on said surface extending circumferentially into a projecting relationship relative to said body and forming a wedge-shaped spur converging to a knife thin edge for insertion under the lifter of a pop-top container for convenient actuation of the lifter, said lug being formed as part of an enlarged portion on said body member and providing a flat surface suitable for containing indicia thereon, whereby said opener may be worn on the finger of a user to assist in opening pop-top cans and twist-off bottle caps without injury to the fingers or the hand.

7. An opener aid comprising:

a ring-shaped unitary body member prescribing a single through opening sized to fit over the finger joints of a user, a lug formed as an integral projection from an enlarged portion of said body member and which extends across the width of the opener aid to form a pair of angularly intersecting flat surfaces, one of said flat surfaces together with a converging tangentially disposed portion projecting circumferentially out of the loop of the ring forming a converging wedge-shaped spur which tapers to a chisel point particularly adapted for insertion under the lifter element of a pop-top can, said flat surfaces forming indicia-bearing surfaces on which may be reproduced selected signal intelligence, whereby a user wearing the ring-shaped body member may conveniently actuate the lifter in response to an upwardly directed force applied by the user, and a circumferentially extending engagement surface on the outer periphery of said ring having knurling corrugations formed thereon to facilitate engagement with the adjoining corrugations of a twist top.

8. An opener aid comprising:

a ring-shaped unitary body member prescribing a single through opening sized to fit over the finger joints of a user, a lug formed as an integral projection from an enlarged portion of said body member and which extends across the width of the opener aid to form a pair of angularly intersecting flat surfaces, one of said flat surfaces together with a converging tangentially disposed portion projecting circumferentially out of the loop of the ring forming a converging wedge-shaped spur which tapers to a chisel point particularly adapted for insertion under the lifter element of a pop-top can, said flat surfaces forming indicia-bearing surfaces on which may be reproduced selected signal intelligence, whereby a user wearing the ring-shaped body member may conveniently actuate the lifter in response to an upwardly directed force applied by the user, and a circumferentially extending engagement surface on the outer periphery of said ring made of a material sufficiently resilient to obtain a firm purchase with the adjoining corrugations of a twist top removable in response to the application of torque.

* * * * *